US006170558B1

(12) United States Patent
Giolo

(10) Patent No.: US 6,170,558 B1
(45) Date of Patent: Jan. 9, 2001

(54) LOW-PRESSURE DIE-CASTING APPARATUS

(75) Inventor: Fabio Giolo, Bagnaria Arsa (IT)

(73) Assignee: IMR S.p.A., Romans d'Isonzo (IT)

( * ) Notice: Under 35 U.S.C. 154(b), the term of this patent shall be extended for 0 days.

(21) Appl. No.: 09/189,996

(22) Filed: Nov. 12, 1998

(30) Foreign Application Priority Data

Nov. 18, 1997 (IT) ..... PD97A0264

(51) Int. Cl.[7] ..... B22D 18/04; B22D 33/04
(52) U.S. Cl. ..... 164/306; 164/337
(58) Field of Search ..... 164/306, 309, 164/335, 337, 119

(56) References Cited

U.S. PATENT DOCUMENTS

| | | | | |
|---|---|---|---|---|
| 5,269,364 | * | 12/1993 | Murata | 164/309 |
| 5,513,690 | * | 5/1996 | Matsubayashi et al. | 164/306 |
| 5,598,882 | * | 2/1997 | Merrill | 164/306 |
| 5,611,388 | * | 3/1997 | Fukuoka et al. | 164/306 X |
| 5,791,398 | * | 8/1998 | Ono et al. | 164/306 |
| 5,937,931 | * | 8/1999 | Hassig | 164/306 X |

FOREIGN PATENT DOCUMENTS

| | | | | |
|---|---|---|---|---|
| 0 811 447 | | 12/1997 | (EP) . | |
| 4-319062 | * | 11/1992 | (JP) | 164/306 |
| 6-320250 | * | 11/1994 | (JP) | 164/306 |
| 415090 | * | 6/1974 | (SU) | 164/309 |
| 431963 | * | 11/1974 | (SU) | 164/309 |
| 442890 | * | 7/1975 | (SU) | 164/309 |
| 603491 | * | 4/1978 | (SU) | 164/306 |
| 1103942 | * | 7/1984 | (SU) | 164/306 |

OTHER PUBLICATIONS

Webster P D et al: "Pressure Sand Casting" Foundry Trade Journal, vol. 169, No. 3505, Apr. 1, 1995, pp. 157–160.
Patent Abstracts Of Japan vol. 007, No. 016 (M–187), Jan. 22, 1983 & Jp 57 171 560 A (Meichiyuu Sangyo KK), Oct. 22, 1982.

* cited by examiner

*Primary Examiner*—J. Reed Batten, Jr.
(74) *Attorney, Agent, or Firm*—Guido Modiano; Albert Josif; Daniel O'Byrne

(57) ABSTRACT

The apparatus comprises at least one flowing furnace with which at least one handling unit cooperates, the handling unit being selectively connectable to a respective die. The at least one handling unit is associated with a guide for horizontal translatory motion between a casting position, which lies above the at least one furnace, and a discharge position. The at least one furnace can move vertically in order to couple and uncouple with respect to the corresponding die connected to the at least one handling unit.

13 Claims, 3 Drawing Sheets

LOW-PRESSURE DIE-CASTING APPARATUS

The disclosures in Italian Patent Application No. PD97A000264 from which this application claims priority are incorporated herein by reference.

BACKGROUND OF THE INVENTION

The present invention relates to a low-pressure die-casting apparatus.

Conventional low-pressure die-casting apparatuses are usually constituted by a flowing furnace into which a tube is immersed in order to dispense, by feeding pressure into the furnace, the liquid metal into a die which is connected in an upward region to the metal draw tube.

In order to form hollow bodies, such as for example faucets and the like, a molding-sand core is arranged inside the die; the core must be destroyed, for example by simple shaking, once casting is completed.

At the furnace there is usually a handling unit which allows to perform the various handlings of the die and to load the cores, unload the cast part and perform all the operations for the graphitization and cooling of the dies.

The die is loaded so that the molten metal must enter it from below, because if the molten metal were to enter from above it would prevent the escape of the air and bubbles would therefore form which would reduce the quality of the finished product.

As mentioned above, the furnace has a tube which enters its crucible to draw in the vicinity of the bottom and in any case with a head which is sufficient to perform a certain number of die filling operations before having to open the furnace and introduce further material to be melted.

In conventional methods, the die is carried by a handling unit exactly above the furnace, as occurs for example in the Italian patent application no. MI96A001138 in the name of the same applicant, is made to descend vertically above it until its lower part, in which there is a hole through which the molten material must enter, makes contact with the tube that draws from the furnace.

Casting occurs by pressurizing the furnace by means of compressed air or another inert gas, so that the liquid metal rises along the tube, filling the entire die.

This method, however, required a very complicated handling unit.

Said handling unit, when it moves from the position above the furnace toward the discharge region, must in fact open in order to allow the exit of the finished product but must also rotate the die halves that constitute the die in order to place them in front of the operator.

In addition to this, the handling unit must be able to overturn the two die halves to allow graphitization and washing and cleaning of all the slag.

Accordingly, the handling unit must have the ability to perform a translatory motion and also to move downwards.

In the system described by the above-mentioned patent application no. MI96A001138 there are two furnaces and the handling unit must operate by moving to one region and then to the other and is accordingly very complicated.

SUMMARY OF THE INVENTION

The aim of the present invention is to provide an improved low-pressure die-casting apparatus the constructive structure whereof is simplified with respect to conventional apparatuses.

A consequent primary object of the present invention is to provide a die-casting apparatus which has a better coupling centering between the furnace and the die.

Another important object of the present invention is to provide an improved casting apparatus which allows to work even with very large dies without any particular difficulty.

Another object of the invention is to provide an improved die-casting apparatus which ensures practical, durable and effective operation.

This aim, these objects and others which will become apparent hereinafter are achieved by an improved low-pressure die-casting apparatus comprising at least one flowing furnace with which at least one handling unit cooperates, said at least one handling unit being selectively connectable to a respective die, characterized in that said at least one handling unit is associated with a guide for horizontal translatory motion between a casting position, which lies above said at least one furnace, and a discharge position, said at least one furnace being movable vertically in order to couple and uncouple with respect to said die connected to said at least one handling unit.

BRIEF DESCRIPTION OF THE DRAWINGS

Further characteristics and advantages of the present invention will become apparent from the description of a preferred embodiment thereof, illustrated only by way of non-limitative example in the accompanying drawings, wherein.

DESCRIPTION OF THE PREFERRED EMBODIMENTS

Figure 1:
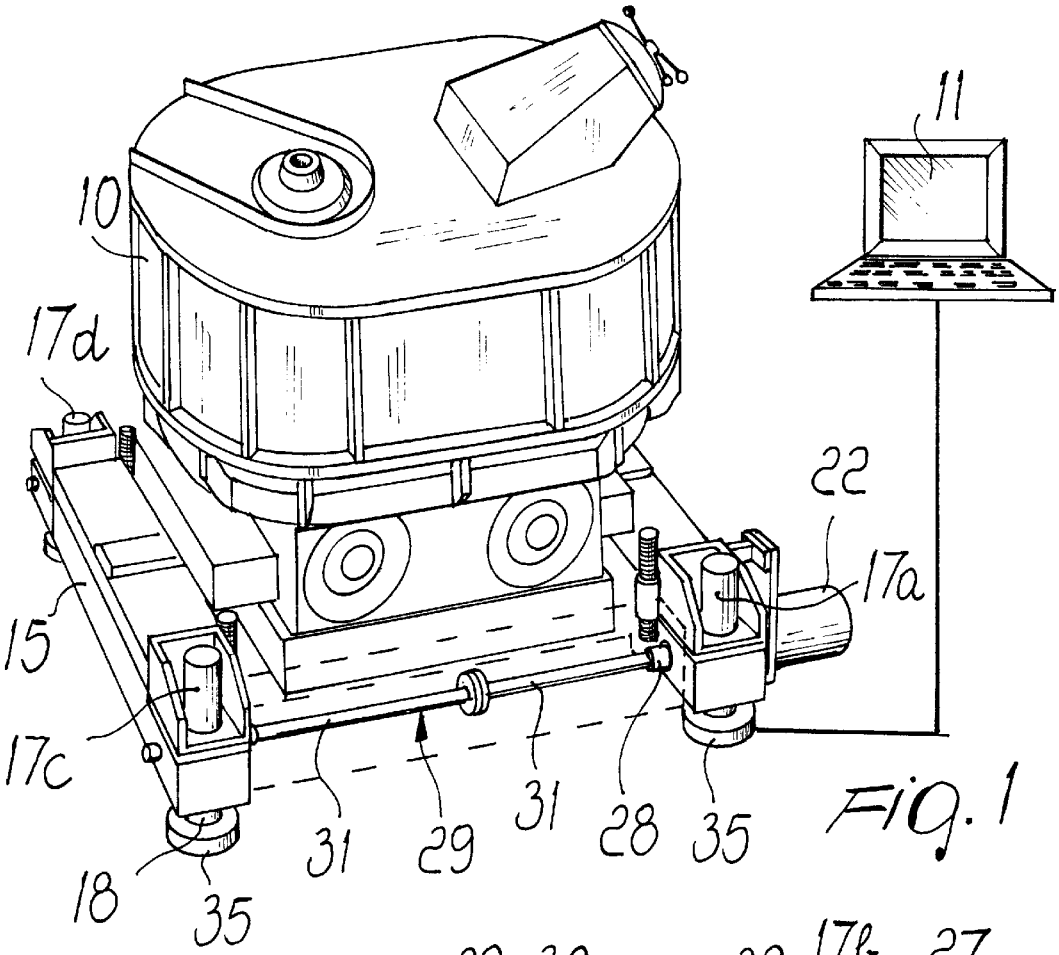
FIG. 1 is a perspective view of a furnace of an improved low-pressure die-casting apparatus according to the invention.

With reference to the above figures, an improved low-pressure die-casting apparatus comprises a flowing furnace 10 of the electric type, or of an equivalent type, controlled by a computerized central unit schematically designated by the reference numeral 11.

The apparatus comprises, in this case, a handling unit 12 which can move horizontally along guides 13 and is adapted to move a die 14 into the casting position.

The handling unit 12 can be arranged above the furnace 10 for casting into d then move horizontally and be arranged at a station for loading/unloading said die 14.

The furnace 10 is supported by a frame 15 provided with means, generally designated by the reference numeral 16, for lifting/lowering with respect to the ground.

The means 16 comprise threaded legs 17*a*, 17*b*, 17*c*, 17*d* which are provided with a foot 18; each leg is coupled to a female thread 19 accommodated inside a box 20.

Each one of the female threads 19 is externally provided with teeth and is coupled, in this case, to a worm screw 21 which is also accommodated inside the box 20.

The lifting/lowering means 16 comprise a motor drive 22 with an output shaft 23 on which a driving pulley 24 is keyed and which engages the worm screw 21 of a first leg 17*a*.

Figure 2:
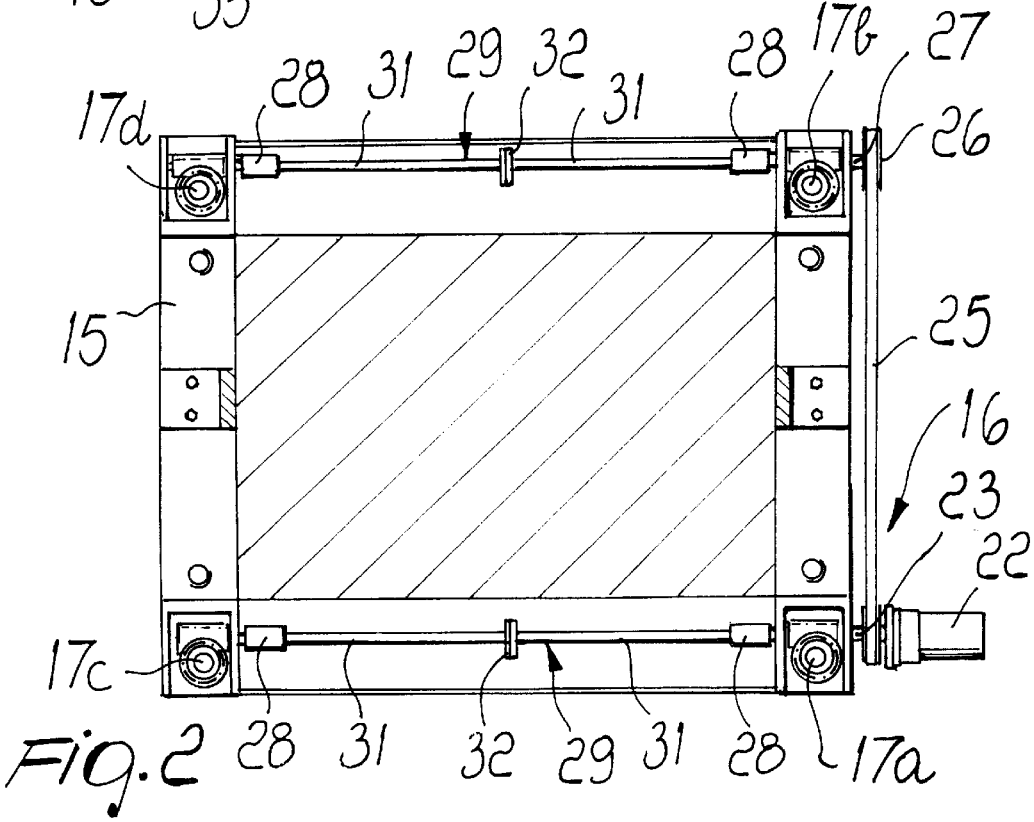
FIG. 2 is a sectional view, taken along a transverse plane, of the flowing furnace shown in FIG. 1.
Figure 3:
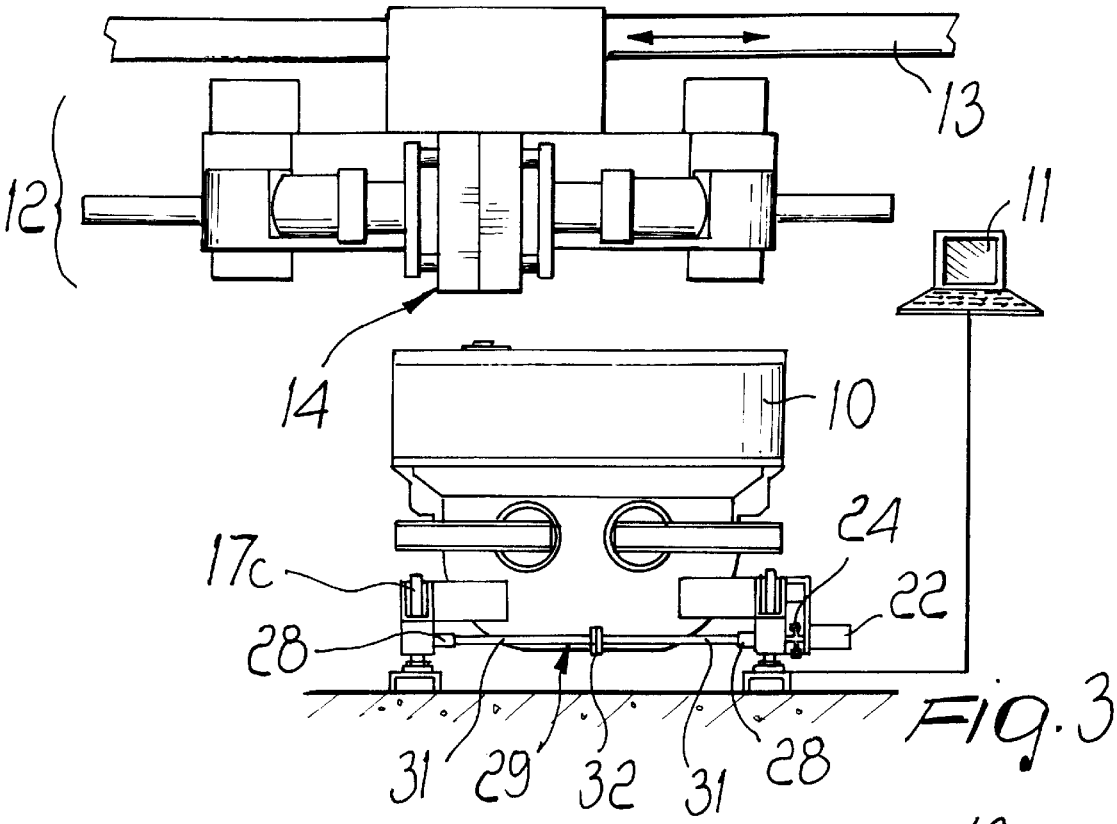
FIG. 3 is a side view of a part of the improved casting apparatus, according to the invention.
Figure 4:
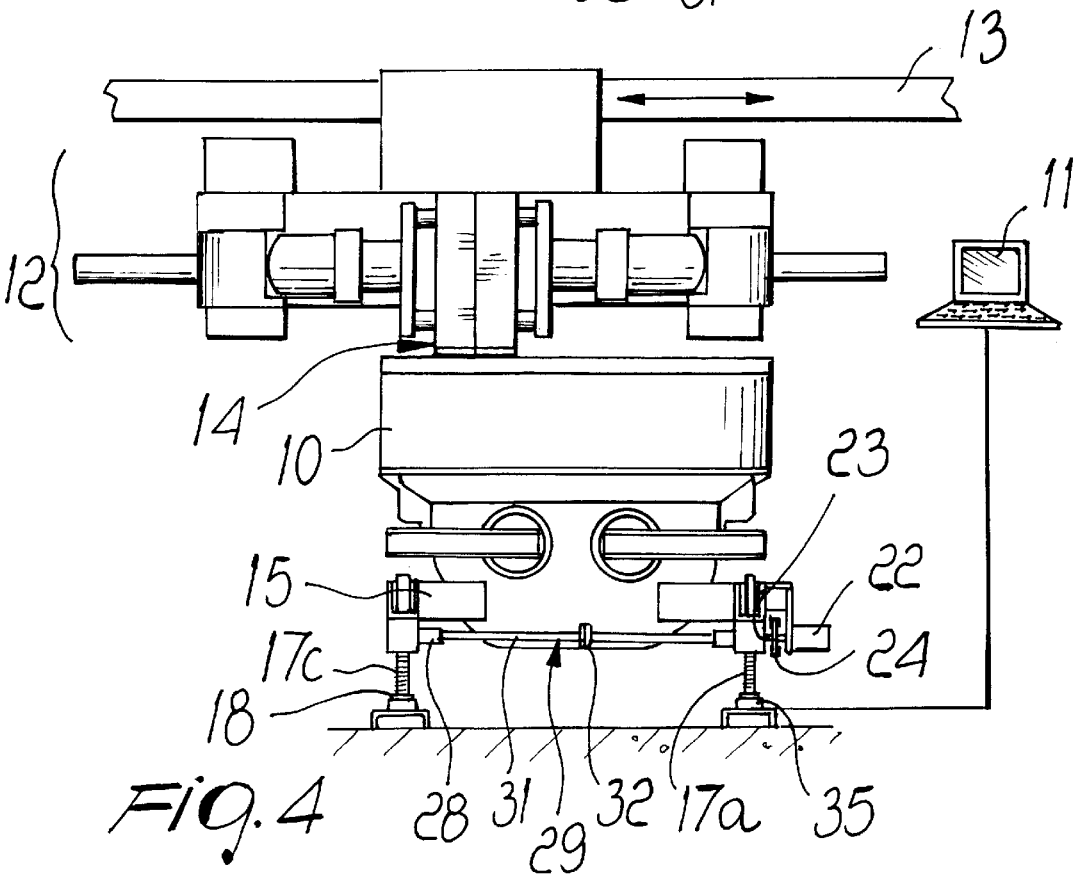
FIG. 4 is a side view of the part of the apparatus shown in FIG. 3 during casting, with the furnace coupled to a die.
Figure 5:
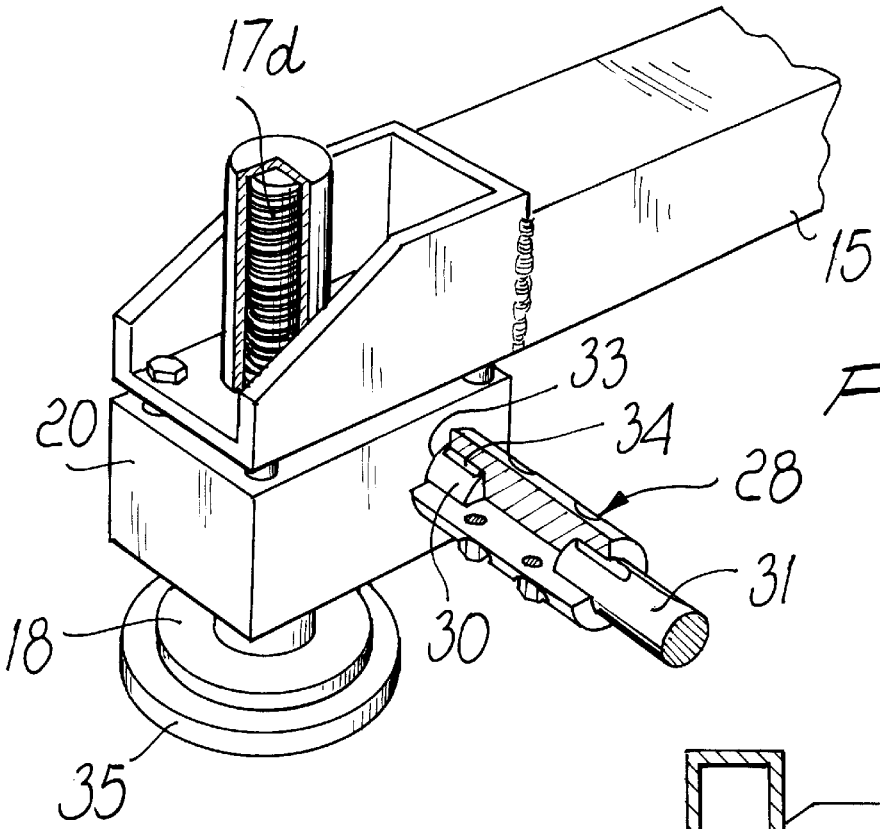
FIG. 5 is a perspective view of a detail of the flowing furnace of FIG. 1.
Figure 6:
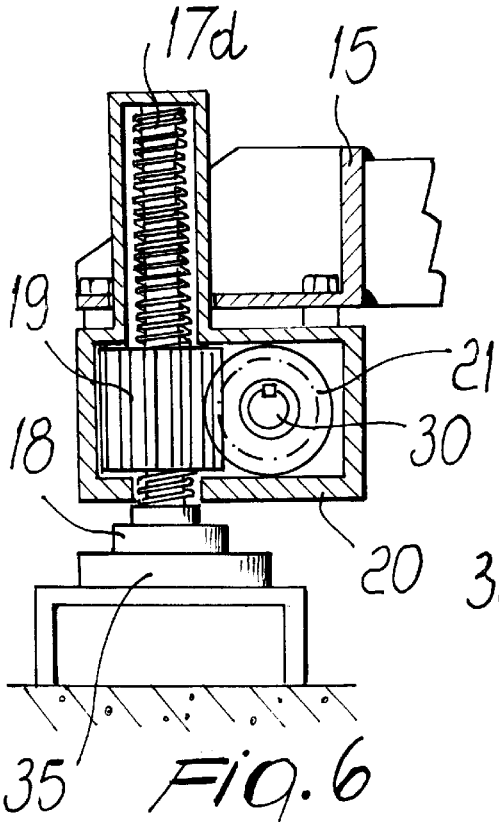
FIG. 6 is a sectional view, taken along a longitudinal plane, of the detail of FIG. 5.
Figure 7:
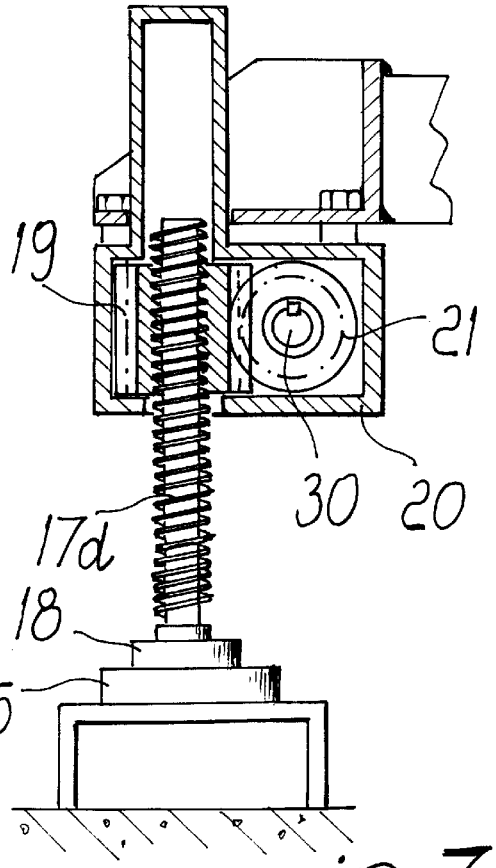
FIG. 7 is a sectional view, taken along a longitudinal plane, of the detail of FIG. 5 during casting.

In particular, said driving pulley 24 (see FIGS. 3–4) is coupled, by means of a toothed belt 25 (see FIG. 2) (or another equivalent flexible element), to a driven pulley 26 which is arranged at a second leg 17*b* and is in turn keyed to a second shaft 27 which engages the worm screw 21 of the second leg 17*b*.

The output shaft 23 and the second shaft 27 are each connected, by means of a first coupling 28, to a third shaft 29. The third shafts 29 are connected, by means of a second coupling 28, to a driven shaft 30 on which said worm screw 21 of said third and fourth legs 17*c* and 17*d* engages.

In this case, each one of the third shafts 29 is constituted by a first shaft portion and by a second shaft portion 31 which are mutually fixed by means of a flanged coupling 32.

The engagement of each one of the shafts 23, 27 and 30 with the worm screws 21 of each one of the legs 17*a*, 17*b*, 17*c* and 17*d* is performed by means of holes 33 formed on each one of said boxes 20 and by means of keys 34 which ensure the transmission of the torque from the shaft 23, 27 or 30 to the worm screw 21, which by meshing with the female thread 19 transmits the rotary motion imparted thereto, causing a consequent lifting or lowering with respect to the corresponding legs 17*a*, 17*b*, 17*c* or 17*d*.

The means 16 in fact ensure the simultaneous lifting or lowering of all the female threads 19 to avoid even the slightest imbalance of the furnace 10, which contains molten metal to be cast into the dies 14.

In this manner, in fact, the handling unit 12 acts only as a device for the horizontal translatory motion of the dies 14, and once it has reached the end of its stroke it is assuredly centered above the furnace 10, so that it is sufficient for the central unit 11 to activate the lifting of the furnace 10 to produce, by pressurizing the furnace 10, the casting of the molten metal into the die 14.

In addition to this, the frame 15 that supports the furnace 10 is mounted on load cells 35 of a per se known type which are also connected to the computerized central unit 11.

The load cells 35 are capable of detecting the load condition of the furnace 10, indicating any need to introduce new material to be melted and the amount introduced.

In particular, however, the load cells 35 detect the moment when the furnace 10, lifted by the female threads 19 actuated by the motor drive 22, makes contact with the handling unit 12 that lies above it and is thus ready to perform casting.

Each load cell 35 in fact detects the activation of the motor drive 22, which synchronously transmits motion to the female threads 19, lifting the furnace 10 while each cell 35 detects the weight of the furnace 10 and the weight of the molten metal contained therein.

Apart from entirely negligible small oscillations, this weight remains constant until said furnace 10 makes contact with the handling unit 12.

At this point the furnace 10 eventually pushes against the die 14 and accordingly each load cell 35 detects a load increase peak due to this slight thrust.

In addition, the load cells 35 allow to automatically vary the pressure in order to always reach the set threshold in the pressurization process for casting the metal into the die, regardless of the variation of the level of the metal in the furnace 10.

The improved apparatus of the invention also allows to work with very large dies, since all the translatory motion problems are considerably simplified and the handling unit merely provides the simple horizontal translatory motion.

Another advantage is achieved with the present invention in that a die-casting apparatus has been provided which has a very simple structure and at the same time ensures truly effective operation.

In practice it has been observed that the present invention fully achieves the intended aim and all the objects.

The invention thus conceived is susceptible of numerous modifications and variations, all of which are within the scope of the same inventive concept.

All the details may furthermore be replaced with other technically equivalent elements.

The materials used, so long as they are compatible with the contingent use, as well as the dimensions, may be any according to the requirements.

What is claimed is:

1. A low-pressure die-casting apparatus comprising: at least one flowing furnace; movement guides; at least one handling unit movable on said guides for cooperating with said at least one flowing furnace; casting dies, said at least one handling unit being selectively connectable to a respective one of said dies and movable with horizontal translatory motion on said guides between a casting position, which lies above said at least one furnace, and a discharge position; and lifting-lowering means for moving said at least one furnace vertically with respect to a ground level in order to couple and uncouple to said respective die connected to said at least one handling unit, said lifting-lowering means comprising female threads rigidly coupled to said furnace in a downward region thereof, and respective threaded legs, fixed at the ground level, which are coupled to said female threads.

2. The apparatus of claim 1, further comprising a motor drive, and a kinematic system for motion transmission, said female threads being connected to said motor drive by way of said kinematic system.

3. The apparatus of claim 2, wherein said kinematic system comprises shafts connected to said motor drive and worm screws keyed to said shafts, said female threads being externally provided with teeth for coupling to said worm screws.

4. The apparatus of claim 3, wherein said shafts comprise a first shaft being an output shaft of said motor drive, and a second shaft being a driven shaft actuated by said first, output shaft, said worm screws being connected to each one of said shafts in corresponding pairs.

5. The apparatus according to claim 4, further comprising a transmission provided with guiding elements and with a flexible element, said flexible element being stretched in a loop between said guiding elements.

6. The apparatus of claim 1, further comprising load cells for detecting the weight of said furnace and the centering thereof with respect to said at least one handling unit, said legs resting on said load cells.

7. A low-pressure die-casting apparatus comprising: at least one flowing furnace; movement guides; at least one handling unit movable on said guides for cooperating with said at least one flowing furnace; casting dies, said at least one handling unit being selectively connectable to a respective one of said dies and movable with horizontal translatory motion on said guides between a casting position, which lies above said at least one furnace, and a discharge position; lifting-lowering means for moving said at least one furnace vertically with respect to a ground level in order to couple and uncouple to said respective die connected to said at least one handling unit, said lifting-lowering means comprising female threads rigidly coupled to said furnace in a downward region thereof, and respective threaded legs, fixed at the ground level, which are coupled to said female threads; and load cells for detecting the weight of said furnace and the centering thereof with respect to said at least one handling unit, said legs resting on said load cells.

8. A low-pressure die-casting apparatus comprising: at least one flowing furnace; movement guides; at least one handling unit movable on said guides for cooperating with said at least one flowing furnace; casting dies, said at least one handling unit being selectively connectable to a respective one of said dies and movable with horizontal translatory motion on said guides between a casting position, which lies above said at least one furnace, and a discharge position; and lifting-lowering means for moving said at least one furnace vertically with respect to a ground level in order to couple and uncouple to said respective die connected to said at least one handling unit, said lifting-lowering means comprising female threads rigidly coupled to said furnace in a downward region thereof, and respective threaded legs, fixed at the ground level, which are coupled to said female threads, said lifting-lowering means ensuring, upon actuation thereof, simultaneous lifting and lowering of said female threads.

9. The apparatus of claim 8, further comprising a motor drive, and a kinematic system for motion transmission, said female threads being connected to said motor drive by way of said kinematic system.

10. The apparatus of claim 9, wherein said kinematic system comprises shafts connected to said motor drive and worm screws keyed to said shafts, said female threads being externally provided with teeth for coupling to said worm screws.

11. The apparatus of claim 10, wherein said shafts comprise a first shaft being an output shaft of said motor drive, and a second shaft being a driven shaft actuated by said first, output shaft, said worm screws being connected to each one of said shafts in corresponding pairs.

12. The apparatus according to claim 11, further comprising a transmission provided with guiding elements and with a flexible element, said flexible element being stretched in a loop between said guiding elements.

13. The apparatus of claim 8, further comprising load cells for detecting the weight of said furnace and the centering thereof with respect to said at least one handling unit, said legs resting on said load cells.

* * * * *